US006360787B1

(12) United States Patent
Williamson

(10) Patent No.: US 6,360,787 B1
(45) Date of Patent: Mar. 26, 2002

(54) DISPENSING MECHANISM FOR A PRODUCE PACKAGING MACHINE

(76) Inventor: Robert L. Williamson, 67602 62nd St., Hartford, MI (US) 49057

( * ) Notice: Subject to any disclaimer, the term of this patent is extended or adjusted under 35 U.S.C. 154(b) by 0 days.

(21) Appl. No.: 09/675,854

(22) Filed: Sep. 29, 2000

(51) Int. Cl.[7] ..... B65B 1/04

(52) U.S. Cl. ..... 141/74; 141/72; 141/129; 141/131; 198/530

(58) Field of Search ..... 141/72–74, 129, 141/131–134; 198/453, 530, 532

(56) References Cited

U.S. PATENT DOCUMENTS 2,921,713 A * 1/1960 Zanotto et al.
4,066,107 A * 1/1978 Karp et al.
4,677,283 A * 6/1987 Lewis

* cited by examiner

*Primary Examiner*—Steven O. Douglas
(74) *Attorney, Agent, or Firm*—R. Tracy Crump

(57) ABSTRACT

A dispensing mechanism for metering produce into "clam shell" type containers carried past the dispensing mechanism by a conveyer, as part of an automated conveyer driven packaging system. The dispensing mechanism includes a side mounted hopper, a guide shoot, and a pair of elongated produce stops. The interior of the hopper is divided by internal partitions into a large bin and a dispensing queue. The body of the hopper has an inclined floor, and converging side and end walls that funnel produce toward two vertically oriented metering gates. One gate meters produce from the large bin into the queue and the second gate meters produce from the hopper into the containers. The guide shoot is pivotally connected to the hopper beneath the second gate. The guide shoot directs the produce from the hopper into the moving containers as they are carried along the conveyer. The produce stops are located in front of the shoot and run directly over and substantially parallel to the conveyer track to prevent the loss of produce and direct the produce into the center of the container base.

18 Claims, 5 Drawing Sheets

DISPENSING MECHANISM FOR A PRODUCE PACKAGING MACHINE

This invention relates to automated packaging machines for small round produce, such as blueberries and cherry tomatoes, and in particular a dispensing mechanism for an automated conveyer driven produce packaging system.

BACKGROUND OF THE INVENTION

Thin plastic containers have become increasingly popular as containers for small produce, such as blueberries, cherry tomatoes, and other small fruit. These containers include a "clam shell" lid, which is integrally attached to one edge of the container and thus may be moved from an open position to a closed position in which the corners of the lid engage the corners of the receptacle to thereby close the container until it is opened by the consumer.

Automated systems have been developed for packaging small produce in clam shell containers. Conventional packaging systems include a variety of automated conveyers and mechanisms, which perform various packaging functions. Generally conveyers are used to transport produce and containers through the various automated work stations, where an automated mechanism performs some packaging operation, such as metering produce into the container or closing the containers after it is filled with produce. While automated systems reduce the time and man power required to get produce to market, cost, complexity and lack of flexibility present several practical and operational draw backs for small produce growers and packagers.

Conventional automated packaging systems use large gravity feed dispensing apparatus. The dispensing apparatus generally include a large hopper and an adjustable gate, which meters the flow of produce from the hopper into the containers, as the containers are carried along a conveyer. The size of the gate opening can be adjusted to increase or decrease the volume of produce flowing into the containers. Generally the gates are located at the bottom of the hoppers, which are suspended directly over the conveyers such that the produce falls directly downward into the containers. The mouth of the gate is elevated above the containers only a short distance to prevent the produce from being damaged by the fall.

Conventional gravity feed dispensing apparatus have had several draw backs. Conventional dispensing mechanisms often damage the produce as it is metered into the containers. Since the metering gates of overhead dispensing hoppers are located directly over the containers and conveyers, the weight of the bulk produce inside the hopper exerts significant pressure on the produce at the mouth of the gate. The pressure on the produce can shear and bruise the produce as it is force through the gate opening. The location of the hoppers directly above the conveyer mechanism, can also contribute to produce damage. If the gate opening is not adjusted to generate the appropriate flow rate, the containers may be over filled. Since the gate is elevated above the containers only a short distance, overfilling the container will result in the excess produce being scrapped off and out of the container by the sides of the gate, as the container is transported along the conveyer. Over filling not only results in shear damage and loss of produce, but may also prevent the container from being closed.

Conventional dispensing mechanisms fail to consistently meter the same volume of produce into each successive container on the conveyer. The location of metering gates in overhead dispensing hoppers creates a "plowing effect," which prevents conventional dispensing mechanisms from metering a consistent volume of produce. The size of individual pieces of produce (berries and the like) varies greatly. As containers pass under the dispensing gate of an overhead hopper, large individual pieces of produce, caught in the gate and not sheared off by the gate of an overhead hopper, block or "plow" smaller pieces of produce from entering the containers. As a result, the volume of produce metered into each successive container varies greatly, with some containers being under filled and others being over filled. In addition, locating the hopper and gate directly over the conveyer also makes regulating the volume and flow rate of the produce through the gate more difficult. The pressure on the produce at the mouth of the gate exerted by the weight of the bulk produce fluctuates with the volume of produce inside the hopper. While the hopper is a gravity feed system, the fluctuation of the pressure exerted on the produce can influence the flow rate of the produce into the containers. Often, the volume of produce inside the hopper is not consistently maintained. As a result, the gate opening must be constantly adjusted to regulate the flow rate of the produce into the containers. While this problem can be reduced by using conveyers to deposit a steady stream of bulk produce into the dispensing hopper, additional conveyers add to the cost and complexity of the packaging system.

Recently, dispensing hoppers for produce packaging machines have been developed to address some of these problems. For example, one packaging system mechanism manufactured by A&B Blueberry Packaging of Hartford, Mich., includes a side located dispensing hopper, which meters produce through a gate in the container at an angle, instead of vertically from an over head hopper. Other dispensing hoppers have included internal baffles, which divert the flow of produce and reduce the pressure on the produce at the mouth of the metering gate. Nevertheless, these apparatus have not adequately addresses the problems of gravity feed dispensing apparatus.

SUMMARY OF THE INVENTION

The dispensing mechanism of this invention is used for dispensing produce into clam shell type containers as part of an automated packaging system. The dispensing mechanism is mounted to a packaging machine that includes a conveyer mechanism for transporting the containers past the dispensing mechanism. The dispensing mechanism is mounted to a subframe, which extends over the conveyer track of a conventional packaging machine. The dispensing mechanism of this invention includes a side mounted hopper, a guide shoot, and a pair of elongated produce stops. The interior of the hopper is divided by internal partitions into a large bin and a dispensing queue. The body of the hopper has an inclined floor, and converging side and end walls that funnel produce toward two vertically oriented metering gates. One gate meters produce from the large bin into the queue and the second gate meters produce from the queue into the containers. The guide shoot is pivotally connected to the hopper beneath the second gate. The guide shoot directs the produce from the hopper into the containers, and also is used to adjust the speed of produce from the hopper into the containers. The produce stops are located in front of the shoot and run directly over and substantially parallel to the conveyer track to prevent the loss of produce and direct the produce into the center of the container base. The stops can be adjusted horizontally and vertically to insure that the containers are filled evenly and without loss of produce.

The dispensing mechanism combines several unique features to address the draw backs of the conventional produce dispensing apparatus. The use of a divided hopper interior and two vertically oriented metering gates, along with the side mounted location of the hopper, allows produce to be dispensed into containers with less damage to the produce and with greater control of the flow rate. The angular attitude of the hopper and the shoot can be independently adjusted to vary the speed of the produce moving through the hopper and over the shoot, respectively. The weight of the bulk produce is exerted directly onto the metering gates. Produce flow through the gate openings at an angle to the direction of gravitational force; consequently, the force exerted on the produce passing through the mouth of the gate is significantly less and the flow rate is less effected by the volume of produce inside the hopper. Dividing the interior of the hopper into a large accumulating bin and a smaller dispensing queue divides the total weight of the produce in the hopper into two areas. The first gate meters produce from the bin into the queue to maintain a relatively constant volume of produce inside the queue. Maintaining a constant volume of produce inside the queue, allows the shoot gate to consistently meter constant flow rate from the hopper, which is unaffected by the volume of the produce inside the bin. In addition, the smaller volume of produce inside the queue, compared to the larger volume in the bin, exerts less pressure on the produce, which has less influence on the flow rate from the hopper into the containers. Consequently, the flow rate through the gate from the queue can be consistently maintained and controlled.

Accordingly, an advantage of this invention is to provide for a dispensing mechanism for an automated conveyer driven packaging system, which dispenses produce at a consistently controlled flow rate to evenly fill each successive container with a uniform volume of produce.

Another advantage of this invention is that the dispensing mechanism reduce damage to the produce.

Another advantage of this invention is that the dispensing mechanism reduces the effect of fluctuations in the volume of bulk produce in the hopper on the flow rate of produce into the containers.

Another advantage of this invention is that each functional component can be readily adjusted to control the volume, speed and flow rate of the produce.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
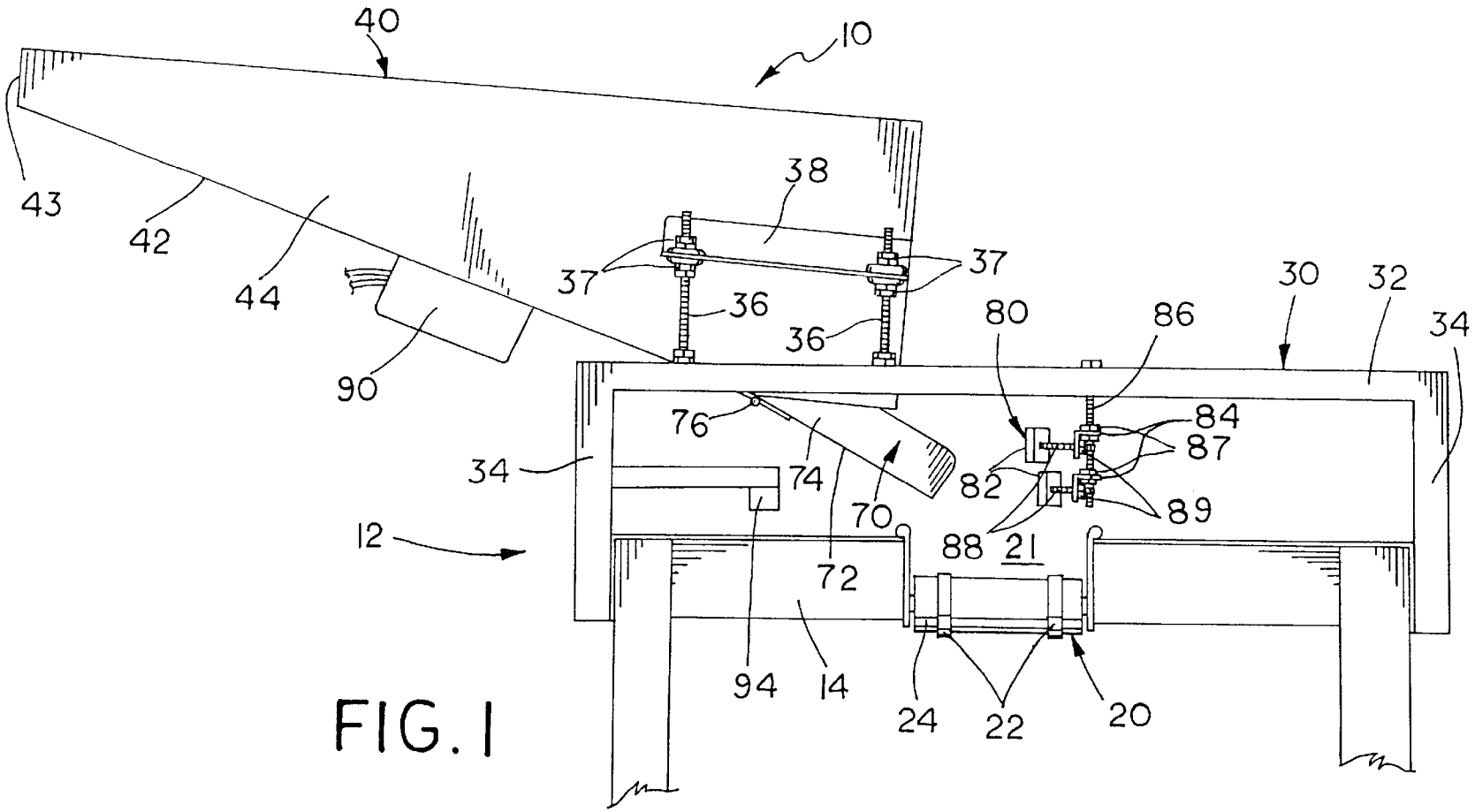
FIG. 1 is a side sectional view of the packaging machine of this invention.

The preferred embodiment herein described is not intended to be exhaustive or to limit the invention to the precise form disclosed. It is chosen and described to best explain the invention so that others skilled in the art might utilize its teachings.

The dispensing mechanism 10 of this invention is illustrated as part of a conveyer driven packaging machine 12. Dispensing mechanism 10 is designed to meter small round produce (designated generally by numeral 2) into conventional "clam shell" type containers 4. In the figures, dispensing mechanism 10 is illustrated with blueberries and clam shell type containers, although the teaching of this invention can be incorporated for any small produce and other types of containers. As shown, containers 4 include a lid 8 and a base receptacle 6, which are connected by a deformable hinge 9 along adjacent sides thereof. Generally, containers 4 are constructed of a clear plastic so that the contents are readily visible to consumers.

Packaging machine 12 includes a fixed frame or table 14 upon which dispensing mechanism 10 and various other packaging components are mounted. As shown, packaging machine 12 includes a conveyer mechanism (designated generally by numeral 20). Conveyer mechanism 20 is of conventional design and is well known to those skilled in the art; therefore it will not be described in great detail. Conveyer mechanism 20 transports containers 4 past dispensing mechanism 10 along a conveyer track 21, which runs the length of table 14. Conveyer mechanism 20 includes a pair of conveyer belts 22, and a plurality of rollers 24 about which belts 22 are trained. Although not shown in the figures, but well known in the art, conveyer mechanism 20 also includes an electric motor and control panel, which drives the conveyer belts and controls the speed of the conveyer belts. Packaging machine 10 may also include packaging components and mechanisms, such as, container de-nesters, produce sizers and container closing mechanisms, as desired without changing the scope of this invention. Such components and mechanisms are well known and need not be described to illustrate the teaching of this invention.

Dispensing mechanism 10 of this invention is mounted to an elevated subframe 30, which transverses over conveyer track 21. Subframe 30 includes two cross members 32 suspended above the conveyer track 21 by two support legs 34. A container lid guide rail 94 is suspended from legs 34 beneath dispensing mechanism 10. Guide rail 94 runs parallel to conveyer mechanism to hold lid 8 in a flat open position as they move under dispensing mechanism 10.

Dispensing mechanism 10 includes a hopper 40, a shoot 70, and a pair of produce stops 80, all adjustably mounted to a subframe 30. As shown in FIG. 1, hopper 40 is adjustably mounted to subframe 30 above and to the side of conveyer track 21. Hopper 40 is adjustably mounted to subframe 30 so that the height of the hopper may be raised and lowered with respect to conveyer track 21 by conventional adjusting bolts 36 and hex nuts 37, which extend through a side bracket 38. This allows machine 10 to be used with containers of various depths. In addition, the angular attitude of hopper 40 may be adjusted by bolts 36 and nuts 37 (hopper can be tilted toward and away from the conveyer).

Figure 3:
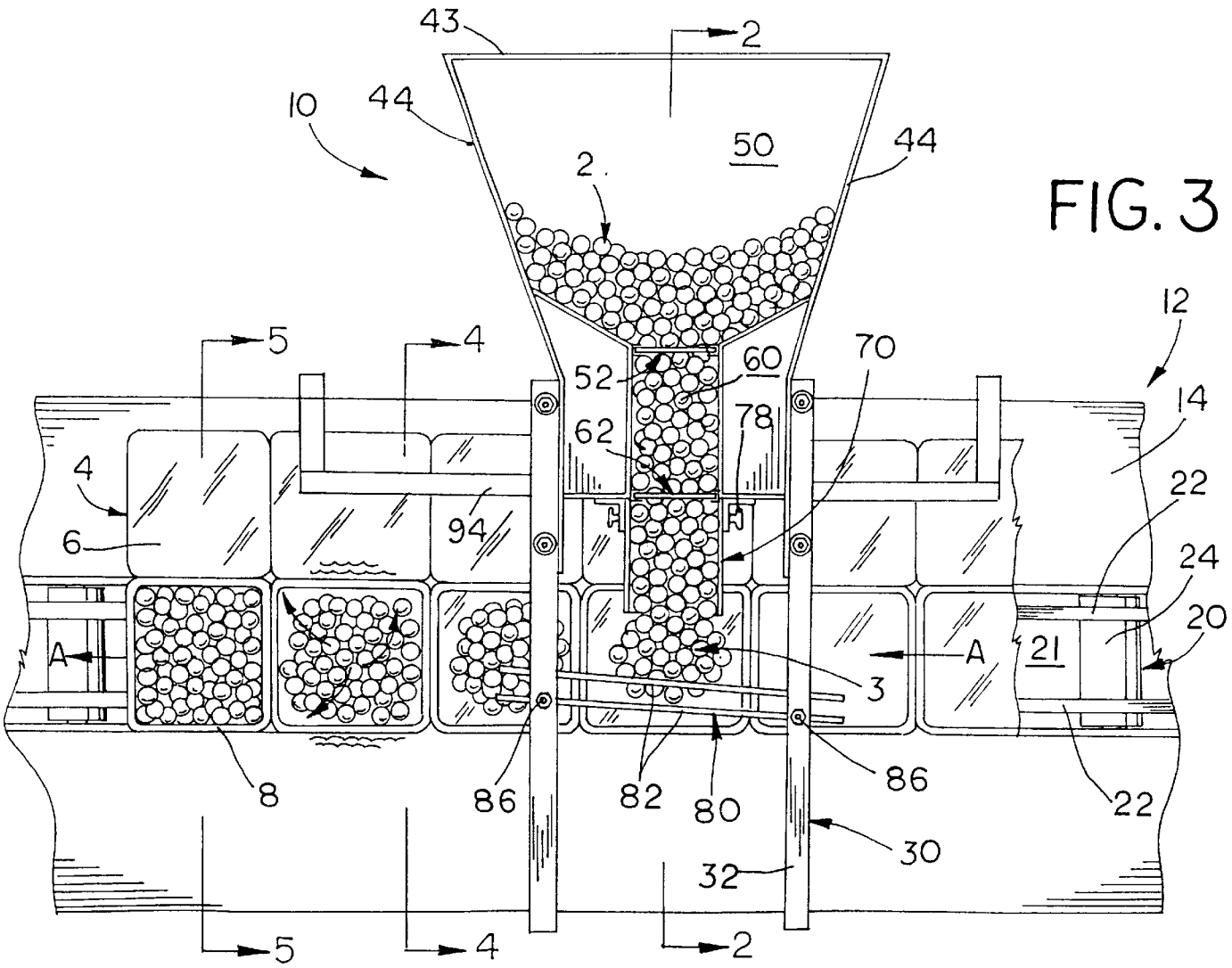
FIG. 3 is a top view of the packaging machine of this invention showing produce being deposited in the containers.
Figure 4:
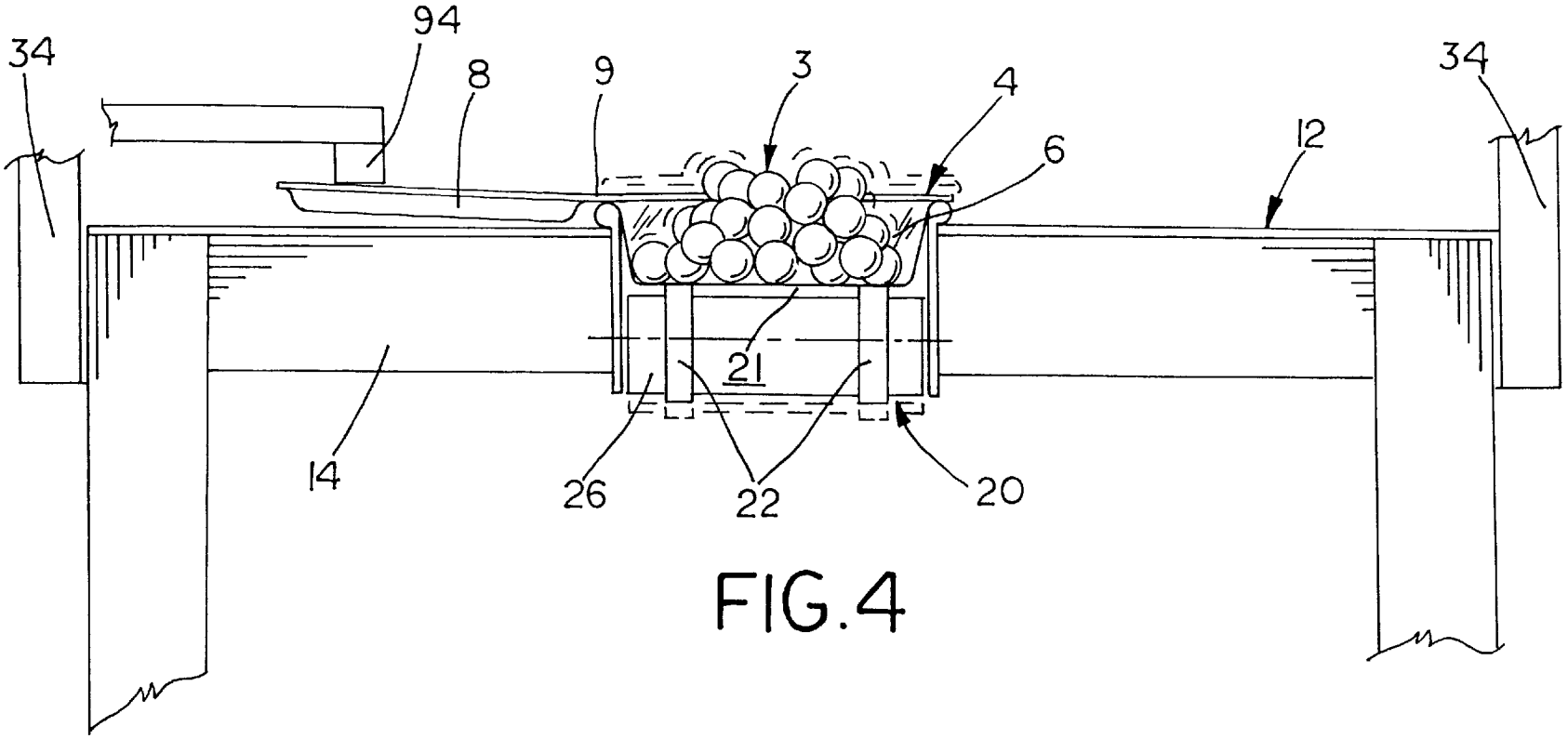
FIG. 4 is a side sectional view taken along line 4—4 of FIG. 3.
Figure 5:
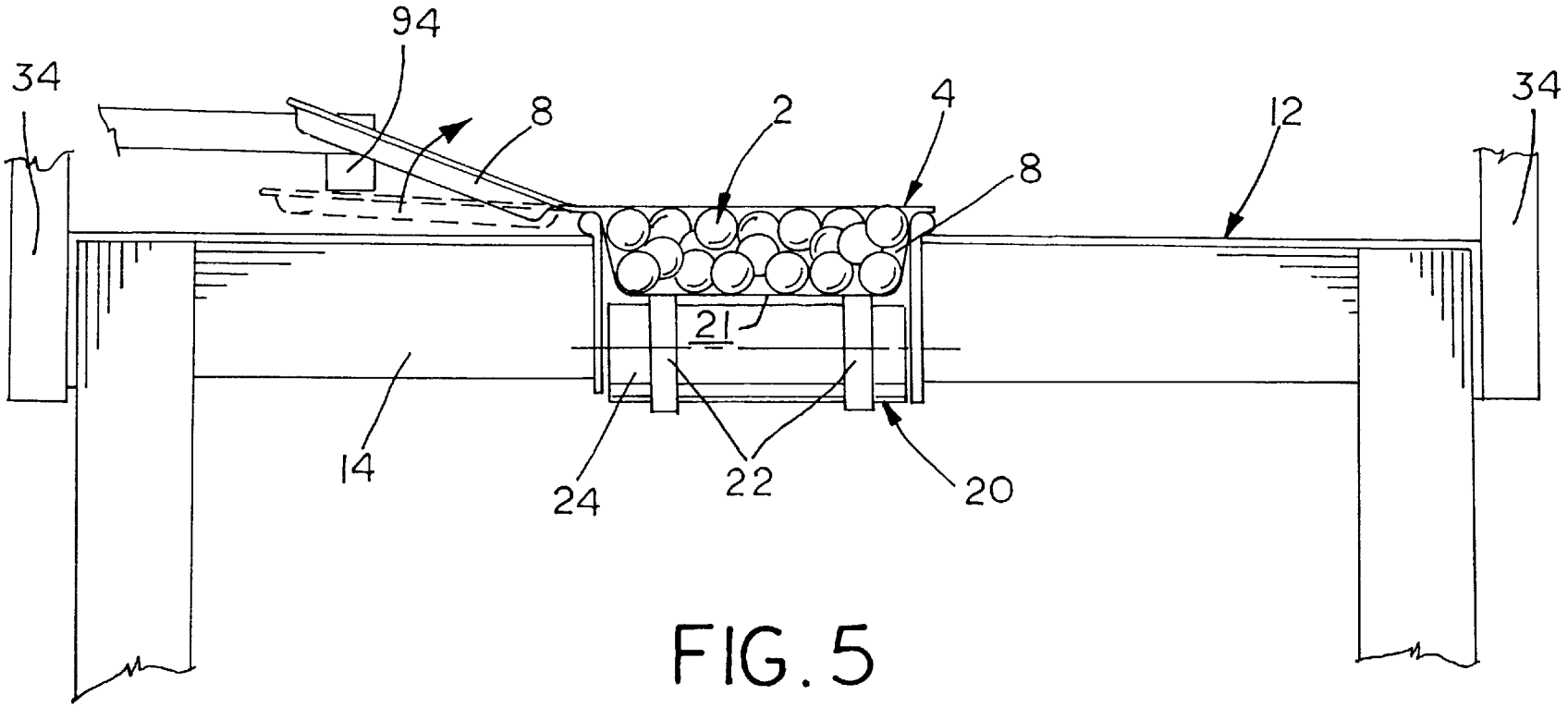
FIG. 5 is a side sectional view taken along line 5—5 of FIG. 3.

The body of hopper 40 is formed by an inclined floor 42, a peripheral end wall 43 and two peripheral side walls 44. As shown in FIG. 3, hopper floor 42 has a trapezoidal shape and peripheral side walls 44, which converge generally toward conveyer track 21. The shape of hopper 40, with the converging side walls and the inclined floor, serves to funnel produce 2 inside the hopper toward conveyer track 21. As shown in FIG. 3, the interior of hopper 40 is divided into two sections: a large receiving bin 50 and a dispensing queue 60. Bin 50 is defined by hopper floor 42, peripheral end wall 43, peripheral side walls 44 and two converging internal partitions 46. Queue 60 is defined by hopper floor 42 and two parallel internal side partitions 48. Hopper 40 also includes two adjustable metering gates 52 and 62. Each gate 52 and 62 includes a sliding baffle 54, 64, respectively, interposed between two sets of parallel flanges 56, 66, respectively. Baffles 54 and 64 can be positioned vertically to manually adjust the size of gate openings 53 and 63, respectively. Generally, baffles 54, 64 are held in position by fiction with flanges 56, 66, but may be secured by fasteners (not shown) if necessary. Gate 52 (the bin gate) meters produce from bin 50 into queue 60, and gate 62 (queue gate) meters produce from queue 60 into guide shoot 70.

Hopper 40 also includes an electrical vibrator 90 mounted to the bottom of hopper floor 42, which facilitates the movement of produce 2 through gates 52 and 62. Vibrator 90 is of conventional design and includes an electric motor, which rotates an eccentric weight to generate a slight vibration in the hopper. Preferably, vibrator 90 is controlled by electrical controls as with the conveyer. This type of electrical vibrator is well known in the art.

As shown, guide shoot 70 is a U-shaped channel formed by flat floor 72 and two vertical side walls 74. As shown in FIG. 3, queue 60 and guide shoot 70 are of substantially equal width. Guide shoot 70 is pivotally connected to hopper 40 beneath the mouth of queue gate 62 by a hinge 76, which allows the guide shoot to pivot upward and downward. As shown in FIG. 3, the end of guide shoot 70 terminates directly over conveyer track 21. Guide shoot 70 can be secured at various positions by fasteners 78 that extend between two slots in the shoot side walls 74 and internal side partitions 48 of hopper 40.

Produce stops 80 are located over conveyer track 21 directly in front of guide shoot 70. Stops 80 deflect produce falling off shoot 70 into containers 4 and prevent produce 2 from falling out of containers 4 onto table 14. Stops 80 also direct the flow of produce 2 into the center of containers 4. As shown, each stop 80 includes an elongated arm 82 mounted to subframe 30 by two sets of threaded adjustment bolts 86, 88 and hex nuts 87, 89. Both pair of adjustment bolts 86, 88 extend through a pair of L-shaped brackets 84 and are secured by hex nuts 87, 89. Vertical adjustment bolts 86 extend downward through slots in cross member 32 and bracket 84, to allow arms 82 to be raised and lowered. Horizontal adjustment bolts 88 extend through bracket 84 to allow arms 82 to be moved horizontally over conveyer track 21 toward or away from guide shoot 70.

Dispensing mechanism 10 of this invention also incorporates a conveyer belt vibrating mechanism (designated generally as numeral 92) into conveyer mechanism 20 to level and settle produce 2 inside container base 6 prior to closing container lid 8. Conveyer belt vibrating mechanism 92 is a conveyer roller with an eccentric axis 26. Roller 26 is located down conveyer track 21 past hopper 40 and guide shoot 70. Movement of conveyer belts 22 rotates roller 26 about its eccentric axis, which in turn generates a slight vertical oscillation in the conveyer belts. The oscillation is transmitted to containers, which facilitates the leveling of produce 2 inside container base 6.

Operation

The operation of dispensing mechanism 10 and packaging machine 12 can be now detailed. As shown, the open containers 4 are transported by conveyer belts 22 along conveyer track 21 past dispensing mechanism 40 in the direction indicated by arrow A. Container bases 6 are seated atop conveyer belts 22 within conveyer track 21 and lids 8 lay open atop table 12 along side of the conveyer track. Containers 4 are deposited into conveyer track 21 in close succession, either manually or by an automated de-nesting mechanism (not shown, but well known in the art). As shown in FIG. 3, containers 4 are carried along conveyer track 21 in close side-by-side succession. Containers 4 are positioned in close succession so that no produce is lost between containers as a steady flow of produce is deposited from the dispensing mechanism into the passing containers. As containers 4 pass under subframe 30 and dispensing mechanism 10, lids are held open and flat against table 14 by rails 94.

The flow rate of produce from the hopper is generally a product of the speed of the produce metered through the gates and volume of the produce metered through the gates. The speed of the produce metered through the gates is generally a function of the angle of inclination of hopper floor 42, while the volume of the produce metered through the gates is a function of the size of the gate openings. Hopper vibrator 90 facilitates the movement of produce through gates 52 and 62 by reducing the effects of friction and the general viscosity of the produce. The angular attitude of hopper 40 and the size of the gate openings 53 and 63 are adjusted to provide an appropriate produce flow rate to filled the passing containers transported at a desired conveyer speed.

Bulk quantities of produce 2 are deposited into bin 50 of hopper 40, either manually or, alternatively, from a separate conveyer apparatus (not shown). Produce 2 funnels under the force of gravity down inclined hopper floor 42 towards bin gate 52 guided by convergent side wall 44 and internal partitions 46. Bin gate 52 meters produce 2 into queue 60, such that a relatively constant volume of produce 2 is inside queue 60 at all times. Queue gate 62 meters produce from queue 60 onto and down guide shoot 70 at a constant rate of flow.

Figure 2:
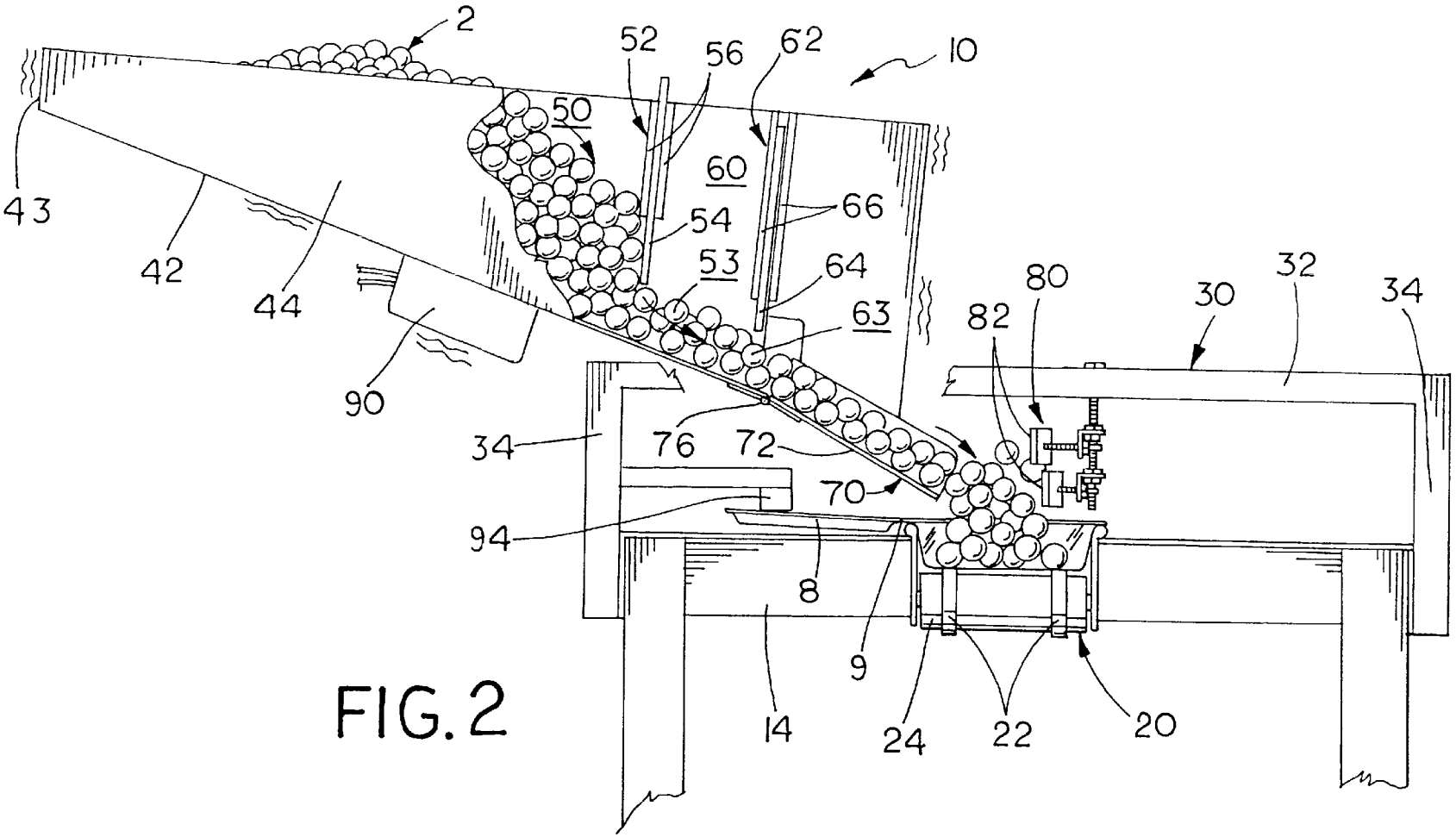
FIG. 2 is a side sectional view taken along line 2—2 of FIG. 3 having portions of the packaging machine cut away to show produce being deposited into a container.

As shown in FIGS. 1 and 2, produce 2 moves down guide shoot 70 and gently off the end into the center of container base 6 guided by stop 80. Produce 2 is deposited into a tall mound (generally designated by numeral 3) at the center of moving container base 6. Moving past guide shoot 70, the filled containers 4 move over roller 26. The oscillation from roller 26 created by the rotation about its eccentric axis generates vibrations, which are transmitted through conveyer belts 22 into the passing filled containers 4 to level produce 2 within container base 6. Once produce 2 is leveled across container base 6, lids 8 are folded over container base 6 to close containers 4. Typically an automated closing mechanism, not shown but well known in the art, is incorporated into packaging machine 10 at the terminal end of conveyer track 21 for this purpose, although, the containers may be closed manually as they move toward the terminal end of the conveyer track.

Advantages

One skilled in the art will note several advantages provided by the combined features of dispensing mechanism 10 for automated produce packaging systems. While some of the features of the dispensing mechanism of this invention are known in the art, these features combine with the unique design and operation of hopper 40, guide shoot 70 and stops 80 to create a more functional and adjustable dispensing apparatus, which consistently controls the rate of produce flow into containers 4 with decreased produce damage.

The side mounted hopper and gate design eliminate the "plowing effect" and allow produce to be dispensed into containers with less damage to the produce and with greater control of the flow rate. Unlike over head hoppers, hopper 40 is located above and off to the side of conveyer track 21, and gate openings 53 and 63 are vertically oriented in the end walls of the hopper. Produce falls laterally into the containers, unobstructed by the gates or the shoot. The weight of the bulk produce is born by inclined floor 42 and not directly on gates 52 and 62. Produce 2 passes through gate openings 53 and 63 at an angle to the direction of gravitational force; consequently, the force exerted on produce 2 passing through gate openings 53 and 63 is significantly less. Because the weight of the bulk produce 2 is exerted directly on gates 52 and 62, the flow rate is less effected by the volume of produce inside hopper 40. The speed of the produce within hopper 40 and through gate openings 53 and 63 can be controlled by varying the angle of inclination of the hopper using adjusting bolts 36 and nuts 37.

The use of a divided hopper interior and two metering gates also reduces the effect of the weight of the produce on the flow rate and facilitates a consistent rate of flow of produce at reduced pressure. Dividing the interior of hopper 40 into a large receiving bin 50 and a smaller dispensing queue 60 divides the total weight of the produce into two separate areas. Since the area of dispensing queue 60 is much less than the area of bin 50, the pressure exerted on the produce within queue 60 is significantly less than that in bin 50. Using bin gate 52 to meter a first flow of produce from the larger bin into the smaller queue, then using queue gate 62 to meter a second final flow of produce from the queue down guide shoot 70 into the containers enables greater control and consistency of the flow rate into containers 4. Bin gate 52 meters produce from bin 50 into queue 60 to maintain a relatively constant volume of produce inside the queue. Queue gate 62 meters produce onto guide shoot 70 and into containers 4. With a constant volume of produce maintained inside queue 60, the pressure exerted by the weight of the produce inside the queue is relatively constant. Consequently, the flow rate metered by queue gate 62 is constant and unaffected by the volume of the produce inside the bin.

Guide shoot 70 and produce stops 80 also contribute uniquely to dispensing mechanism 10 of this invention. Since shoot 70 and opening 63 have the same width, the shoot transports the same volume of produce as metered through queue gate 62. Guide shoot 70 not only directs produce 2 from hopper 40 into containers 4, but also is used to adjust the speed of the produce from the hopper into the containers. The angle of inclination of guide shoot 70 can be adjusted to increase or decrease the speed at which the volume of produce is metered through queue gate 62 into containers 4. The flow of produce dispensed from hopper 40 can be adjusted by varying the angle guide shoot 70 to slow or speed the flow into containers 4. Increasing the speed of the produce flow across guide shoot 70 creates a slight Bernoulli effect, whereby the pressure exerted on the produce decreases and the produce falls gently into containers 4. Stops 80 prevent the loss of the produce and deflect the produce into the center of container base 6 so that container 4 can be filled evenly as the containers are carried by conveyer belts 22.

The combination of features and adjustments of dispensing mechanism 10 creates a constant volume of produce entering the passing containers. By reducing the pressure and force exerted on the volume of produce entering the containers, dispensing mechanism 10 can provide a flow of the produce to uniformly fill each successive container relatively independent of the conveyer speed, thereby eliminating the need to precisely match the flow rate to the speed of the conveyer. The volume of produce dispensing into each successive container is more consistent, thereby reducing overfilled and under filled containers.

It is understood that the above description does not limit the invention to the details given, but may be modified within the scope of the following claims.

I claim:

1. In an automated produce packaging system (12) for packaging produce (2) into containers (4) carried on a conveyer (20), a dispensing mechanism (10) for dispensing a volume of produce in to the container carried past the dispensing mechanism by the conveyer, the dispensing mechanism (10) comprising:

hopper (40) elevated above and spaced laterally from the containers carried by the conveyer, the hopper (40) defining an interior for receiving produce therein, including interior partitions (46, 48) for dividing the hopper interior into a first interior area (50) and a second interior area (60), and having a first opening (53) for dispensing produce form the first interior area into the second interior area and a second opening (63) for dispensing produce from the second interior area into the containers;

first gate means (52) disposed within the interior of the hopper for metering produce through the first opening from first interior area into the second interior area so as to maintain a constant volume of produce within the second area;

second gate means (62) disposed within the hopper for metering the produce through the second opening from the second interior area at a substantially constant rate of flow; and means (70, 80) for directing produce from the second gate means laterally into the containers at a selectable angle.

2. The mechanism of claim 1 wherein the first opening (53) and the second opening lie in a substantially vertical plane, thereby produce is metered laterally through the first opening and the second opening.

3. The mechanism of claim 1 wherein the first gate means (52) includes a baffle (54) and means (56) for selectably positioning in the baffle vertically within the first opening to vary the size of the first opening.

4. The mechanism of claim 1 wherein the second gate means (62) includes a baffle (64) and means (66) for selectably positioning in the baffle vertically within the second opening (63) to vary the size of the first opening.

5. The mechanism of claim 1 wherein the guide means includes an elongated shoot (70) for transporting the produce dispensed from the second gate means laterally into the containers, and means (76) for pivotally connecting one end of the shoot to the hopper adjacent the second opening to selectively position the other end of the shoot over the container at varying angles so as to regulate the speed of the produce dispensed into the container.

6. The mechanism of claim 5 wherein the guide means also include means (80) for deflecting produce dispense from the second gate means and moving off the shoot into the container.

7. The mechanism of claim 6 herein deflecting means (80) includes two elongated arms (82) and means ( 84, 86–89) for selectively suspending the arms over the container and atop one another so as to deflect produce falling from the shoot into the container.

8. The mechanism of claim 1 wherein the hopper (40) includes a floor (42) and plurality of peripheral walls (43, 44), which define the interior thereof, the floor being inclined towards the first opening and the second opening and having an angle of inclination which facilitates movement of the produce under the force of gravity through the first opening and the second opening.

9. The mechanism of claim 8 wherein the hopper (40) also includes means (36, 37) for selectably adjusting the angle of inclination of the floor to selectably control the speed of the produce through the first opening and second opening.

10. The mechanism of claim 1 wherein the hopper also includes means for vibrating the floor so as to overcome the inertia and static resistance of the produce inside the hopper interior and urge the produce through the first opening and the second opening.

11. The mechanism of claim 1 also includes means for transmitting vibration to the containers to level the produce within the container after the produce has been deposited into the containers.

12. The mechanism of claim 1 wherein the second interior area has a smaller volume than the first interior area.

13. In an automated produce packaging system (12) for packaging produce (2) into containers (4) carried on a conveyer (20), a dispensing mechanism (10) for dispensing a volume of produce into the container carried past the dispensing mechanism by the conveyer, the dispensing mechanism (10) comprising:

hopper (40) elevated above and spaced laterally from the containers carried by the conveyer, the hopper (40) defining an interior for receiving produce therein, including interior partitions (46, 48) for dividing the hopper interior into a first interior area (50) and a second interior area (60), and having a first opening (53) for dispensing produce form the first interior area into the second interior area and a second opening (63) for dispensing produce from the second interior area into the containers;

first gate means (52) disposed within the interior of the hopper for metering the produce through the first opening from the first interior area into the second interior area so as to maintain a constant volume of produce within the second area;

second gate means (62) disposed within the hopper for metering the produce through the second opening from the second interior area at a substantially constant rate of flow;

an elongated shoot (70) for transporting the produce dispensed from the second gate means laterally into the containers;

hinge (76) for pivotally connecting one end of the shoot to the hopper adjacent the second opening to selectively position the other end of the shoot over the container at varying angles so as to regulate the speed of the produce dispensed into the container;

two elongated arms (82) for deflecting produce dispensed from the second gate means and moving off the shoot into the container; and means (84, 86–89) for selectively suspending the arms over the container and atop one another so as to deflect produce falling from the shoot into the container.

14. The mechanism of claim 13 wherein the first opening (53) and the second opening lie in a substantially vertical plane, thereby produce is metered laterally through the first opening and the second opening.

15. The mechanism of claim 13 wherein the hopper (40) includes a floor (42) and plurality of peripheral walls (43, 44), which define the interior thereof, the floor being inclined towards the first opening and the second opening and having an angle of inclination which facilitates movement of the produce under the force of gravity through the first opening and the second opening.

16. The mechanism of claim 15 wherein the first gate means (52) includes a baffle (54) and means (56) for selectably positioning in the baffle vertically above the floor within the first opening to vary the size of the first opening.

17. The mechanism of claim 15 wherein the second gate means (62) includes a baffle (64) and means (66) for selectably positioning in the baffle vertically above the floor within the second opening (63) to vary the size of the first opening.

18. The mechanism of claim 15 wherein the hopper (40) also includes means (36, 37) for selectably adjusting the angle of inclination of the floor to selectably control the speed of the produce through the first opening and second opening.

* * * * *